US006573224B2

(12) United States Patent
McNeil et al.

(10) Patent No.: US 6,573,224 B2
(45) Date of Patent: Jun. 3, 2003

(54) TWO-CYCLE ENGINE LUBRICANT COMPOSITION COMPRISING AN ESTER COPOLYMER AND A DIESTER

(75) Inventors: Hugh A. McNeil, Seattle, WA (US); Arthur J. Kiehn, Seattle, WA (US); Mark Eskridge, Seattle, WA (US)

(73) Assignee: Bardahl Manufacturing Corporation, Seattle, WA (US)

( * ) Notice: Subject to any disclaimer, the term of this patent is extended or adjusted under 35 U.S.C. 154(b) by 50 days.

(21) Appl. No.: 09/927,294

(22) Filed: Aug. 10, 2001

(65) Prior Publication Data

US 2002/0042348 A1 Apr. 11, 2002

Related U.S. Application Data

(63) Continuation of application No. 09/001,892, filed on Dec. 31, 1997, now abandoned.
(60) Provisional application No. 60/034,713, filed on Jan. 3, 1997.

(51) Int. Cl.[7] ..... C10M 111/04
(52) U.S. Cl. ..... 508/383; 508/118; 508/175; 508/468; 508/485; 508/496
(58) Field of Search ..... 508/175, 468, 508/485, 496, 383

(56) References Cited

U.S. PATENT DOCUMENTS 2,543,964 A * 3/1951 Giammaria ..... 252/56
2,692,233 A * 10/1954 Cottle et al. ..... 252/56
2,798,083 A * 7/1957 Bell et al. ..... 260/410.6
2,820,014 A * 1/1958 Hartley et al. ..... 252/56
3,655,559 A * 4/1972 Holt ..... 252/51.5 A
4,548,725 A * 10/1985 Bridger ..... 252/56 R
4,839,874 A * 6/1989 Namisato ..... 368/76
4,994,196 A * 2/1991 Kagaya et al. ..... 252/32.5
5,160,349 A * 11/1992 Cardis et al. ..... 44/331
5,176,841 A * 1/1993 Wallfahrer et al. ..... 252/56 D
5,256,323 A * 10/1993 Wirth et al. ..... 252/42.7
5,312,554 A * 5/1994 Waddoups et al. .. 252/32.007 E
5,328,621 A * 7/1994 Camenzind et al. ..... 252/46.6
5,356,546 A * 10/1994 Blystone et al. ..... 252/35
5,360,563 A * 11/1994 Zinke et al. ..... 252/46.7
5,399,276 A * 3/1995 Benjamin et al. ..... 252/49.9
5,435,928 A * 7/1995 Beck ..... 252/560
5,481,039 A 1/1996 Wirth et al. ..... 568/6
5,498,358 A 3/1996 Kim et al. ..... 252/51.005 A
5,507,963 A 4/1996 Wolf ..... 252/50
5,817,607 A 10/1998 Duncan et al. ..... 508/485
5,965,498 A * 10/1999 Smythe

OTHER PUBLICATIONS

Kiehn et al., "Can 2–Cycle Engine Performance Be Enhanced through Use of Combustion Modifiers, Synthetic Base Oils, and Anti–Scuff Compounds," in 1991 Small Engine Technology Conference, SAE P–254, 1991.*

* cited by examiner

*Primary Examiner*—Jerry D. Johnson
(74) *Attorney, Agent, or Firm*—Seed Intellectual Property Law Group PLLC

(57) ABSTRACT

Improved performance of two-cycle and four-cycle engines is achieved by adding to the oil or fuel of such engines a composition that contains a copolymer of an alpha-olefin and a dialkyl fumarate or maleate and/or a synthetic diester compound that has about 30 carbon atoms. For two-cycle engines, the composition preferably contains both chemicals, in addition to an octane booster such as methyl-cyclopentadienyl manganese tricarbonyl. For four-cycle engines, the composition contains at least one of the copolymer and diester, in addition to a molybdenum or bismuth salt, dimercapto 1,3,4-thiadiazole and sulfur-phosphorous EP and/or chlorinated paraffin. The composition can also act to improve gear and grease lubrication and provide improved lubricity to fuels.

10 Claims, No Drawings

TWO-CYCLE ENGINE LUBRICANT COMPOSITION COMPRISING AN ESTER COPOLYMER AND A DIESTER

CROSS-REFERENCE TO RELATED APPLICATIONS

This application is a continuation of U.S. patent application Ser. No. 09/001,892, filed Dec. 31, 1997, now abandoned, which claims the priority benefit of U.S. Provisional Application No. 60/034,713 filed Jan. 3, 1997.

TECHNICAL FIELD

This invention relates generally to lubricant compositions and fuel-lubricant mixtures useful in internal combustion engines. It is particularly useful in two-cycle engines, four-cycle engines, grease lubricants, fuels (diesel and gasoline), and gears, and to methods of treating two-cycle engines, four-cycle engines, and gears to improve their cleanliness and operating efficiency.

BACKGROUND OF THE INVENTION

The use of lubricants in two-cycle and four-cycle engine operation is common place. Such lubricants serve to allow facile movement between adjoining moving parts of the engine. However, the use of lubricants, as well as the fuels used to power the engine, often cause undesirable side-effects. Such side-effects include deposition of partially oxidized organic materials along pistons and other moving parts. These deposits interfere with the efficient operation of both two-cycle and four-cycle engines and gears.

Over the past several decades, the use of spark-ignited two-cycle (2-stroke) internal combustion engines has steadily increased. They are presently found in power lawn mowers and other power-operated garden equipment, power chain saws, pumps, electrical generators, marine outboard engines, snowmobiles, motorcycles and the like. The increasing use of two-cycle engines coupled with increasing severity of the conditions in which they have operated has led to an increased demand for oils to adequately lubricate such engines and which provide enhanced performance. Among the problems associated with two-cycle engines are piston ring sticking, piston scuffing, rusting, lubrication-related failure of connecting rod and main bearings and the general formation on the engine's interior surfaces of carbon and varnish deposits. Piston ring sticking is a particularly serious problem. Ring sticking leads to failure of the sealing function of piston rings. Such sealing failure causes loss of cylinder compression which is particularly damaging in two-cycle engines because these engines depend on suction to draw the new fuel charge into the exhausted cylinder. Thus, ring sticking can lead to deterioration in engine performance and unnecessary consumption of fuel and/or lubricant. Other concerns associated with two-cycle engines include piston lubricity, scuffing and scoring.

Four cycle engines, commonly found in automobiles, have been use for over 60 years. However, their operation is still attended by problems such as the production of organic and to some extend inorganic deposits on the internal surfaces of the engine. Where these surfaces are moving parts (e.g., pistons), a severe decrease in engine operating efficiency attends such deposits.

Gears are used in industry, transportation, and many other areas. Gears transmit power and alter the direction of movement. The load on gear teeth (the load-bearing surface) is intermittent and higher than on most other bearing or loaded surfaces. The lateral sliding action of gear teeth imposes severe lubrication requirements. While gear lubricants must have superior anti-wear and extreme pressure protection they must also be non-corrosive to "yellow metal" (copper alloy) components. Gear lubricants, particularly ones used in mining, milling, and similar operations need to be composed of high viscosity index oils and extreme pressure/anti-wear agents.

Grease lubrication of bearings, gears, and other components is used when seals or other devices can not be used to prevent migration of the lubricant away from lubricated surfaces. Grease consists of thickeners, typically 6 to 10 percent by weight of the mixture, lubricating oil, and additives to enhance the performance of the grease. The thickener in grease acts as a "sponge" to keep the oil and additives on the bearing, gear, or other component being lubricated. The additives used in grease blending are similar to the ones used in the production of gear, engine oil, and other petroleum based lubricants.

The lubrication of fuel system components such as diesel pumps, diesel injectors, gasoline engine valves, the upper cylinder, and ring area of four cycle and two cycle engines has become an important area of research as fuel composition changes to meet new environmental regulations. Upper cylinder lubricants act to lubricate and clean the ring and upper cylinder area of spark and compression ignition engines. This action can benefit fuel economy, emissions, as well as ring and cylinder wear. The introduction of low sulfur diesel fuels has increased wear in pumps and diesel fuel injectors. Lubricants that will operate successfully at high temperatures and not contribute to damage of emission control devices are difficult to develop.

All of the aforementioned problems associated with two-cycle and four-cycle engines must be adequately addressed. Improved performance is continually being sought. The unique problems and techniques associated with the lubrication of two-cycle and four-cycle engines has led researches to develop a wide variety of products. However, further improvements in terms of combustion efficiency, lubrication efficiency and the like are still needed. The present invention fulfills these needs and provides further advantages in the context of in engine lubrication.

SUMMARY OF THE INVENTION

In brief, the present invention is directed to lubricant and anti-wear compositions for two-cycle and four-cycle engines. Suitable compositions for two-cycle engines comprise a copolymer of an alpha olefin and diester selected from a dialkyl fumarate and a dialkyl maleate, an aliphatic diester having exactly two ester groups and about 20–40 carbon atoms, preferably in the presence of an octane booster, such as methylcyclopentadienyl manganese tricarbonyl.

Suitable anti-wear compositions for four-cycle engines comprise a copolymer of an alpha olefin and diester selected from a dialkyl fumarate and a dialkyl maleate, a molybdenum or bismuth compound, an anti-corrosion additive such as dimercapto 1,3,4 thiadiazole and a extreme pressure additive such as sulfur-phosphorous EP or chlorinated paraffin. A fullerene compound (optionally dissolved in mineral oil) is a preferred optional ingredient for the anti-wear composition.

Another suitable gear lubricant composition is made with a copolymer of an alpha olefin and diester selected from a dialkyl fumarate and a dialkyl maleate, a molybdenum or bismuth compound, an anti-corrosion additive such as dimercapto 1.3.4 thiadiazole. A fullerene compound (optionally dissolved in mineral oil) is a preferred optional ingredient for the anti-wear composition. This blend may also be used as an anti-wear and extreme pressure additive in grease and fuels.

Another suitable composition for four-cycle engines is termed herein a synthetic lubricant composition (SLC) and comprises one or both of a copolymer of an alpha olefin and diester selected from a dialkyl fumarate and a dialkyl maleate, and an aliphatic diester having exactly two ester groups and about 20–40 carbon atoms. The SLC further comprises a molybdenum or bismuth compound, an anti-corrosion additive such as dimercapto 1,3,4 thiadiazole, and extreme pressure additive such as sulfur-phosphorous EP or chlorinated paraffin (optionally in an oil (e.g., vegetable oil) base), and fullerene (optionally in an oil (e.g., naphthalenic oil) base).

In another aspect, the invention is directed to operation of two-cycle and four-cycle engines using the compositions of the invention, as well as gear oil and grease lubricants.

These and other aspects of this invention will become apparent upon reference to the following detailed description.

DETAILED DESCRIPTION OF THE INVENTION

As briefly explained above, the invention is directed to compositions that may be added to internal combustion engines, particularly two-cycle and four-cycle engines, in order to improve the performance thereof. In addition, the invention is directed to methods of operating internal combustion engines under conditions of high efficiency and cleanliness of operation. The various compositions of the invention will now be described, followed by a more detailed description of their required and optional ingredients.

The invention provides for an anti-wear additive concentrate suitable for a four-cycle engine. This concentrate contains ester copolymer, one or more molybdenum or bismuth compounds, dimercapto 1,3,4 thiadiazole compound and at least one of sulfur-phosphorous EP and chlorinated paraffin. A preferred optional ingredient for the anti-wear additive concentrate is a fullerene-rich oil, and a further preferred optional ingredient is a mineral oil.

The anti-wear additive concentrate contains, on a volume percent basis based on the total volume of the concentrate, the following amounts of the various required and optional components. Ester copolymer: 1–20, preferably 2–10.

Molybdenum or bismuth compound: 10–50, preferably 20–40. Dimercapto 1,3,4 thiadiazole compound: 1–10, preferably 2–8. Sulfur-phosphorous EP and/or chlorinated paraffin: 10–50, preferably 15–45. Mineral oil: 10–40, preferably 15–30. Fullerene: 0.1 to 2.5, preferably 0.5 to 2.

The anti-wear additive would typically be used by manufacturers of motor oil and would constitute a portion of the motor oil. The anti-wear additive might be blended with a base lubricant or oil to provide a hydraulic oil, gear oil or grease. Methods of blending and components suitable for motor oil, hydraulic oil, gear oil, grease and the like are well known to those of skill in the art.

The invention also provides for a SLC engine treatment suitable for a four-cycle engine, where SLC stands for synthetic lubricant concentrate. The SLC engine treatment contains at least one of ester copolymer and diester, as well as a molybdenum or bismuth compound, dimercapto, 1,3,4 thiadiazole, at least one of sulfur-phosphorous EP (optionally in combination with vegetable oil base) and chlorinated paraffin, and also contains fullerene rich oil. A preferred optional ingredient for the SLC engine treatment is mineral oil and/or a motor oil additive package.

The SLC engine treatment contains, on a volume percent basis based on the total volume of the engine treatment, the following amounts of the various required and optional components: ester copolymer and/or diester: 1–15, preferably 2–10. Molybdenum or bismuth compound: 1–50, preferably 20–40. Dimercapto, 1,3,4 thiadiazole compound: 1–10, preferably 2–8.

Sulfur-phosphorous EP (optionally with vegetable oil base) and/or chlorinated paraffin: 1–40, preferably 10–35. Mineral oil: 10–40, preferably 15–30. Fullerene rich oil: 1–5, preferably 2–4. Motor oil additive package: 1–30, preferably 10–20.

The SLC may be added directly to a car or other motor vehicle engine, along with the oil which is typically added to the engine. Preferably the engine is a four-cycle engine.

In another aspect, the invention also provides for a two-cycle engine treatment composition. This composition contains at least ester copolymer, diester and methylcyclopentadienyl manganese tricarbonyl. Preferred optional ingredients for the two-cycle engine treatment composition contains base oil and liquid hydrocarbon. The two-cycle engine treatment composition contains, on a volume percent basis based on the total volume of the composition, the following amounts of the various required and optional components: ester copolymer: 1–20, preferably 5–15. Diester oil: 1–40, preferably 15–30. Methylcyclopentadienyl manganese tricarbonyl: 0.1–5, preferably 0.5–2, more preferably 0.5–1. Base oil: 20–70, preferably 40–50. Liquid hydrocarbon: 5–50, preferably 20–35.

The ester copolymer and diester together afford cleanup and emission (smoke) reduction benefits. A volume ratio of ester copolymer: diester of about 1:1–1:4, preferably about 1:2 is preferred. It is also preferred that about 20–50, and more preferably about 25–40 volume percent of the two-cycle engine treatment composition consists of the blend of ester copolymer and diester.

A preferred composition for treatment of a two-cycle engine contains 8–15 volume percent of ester copolymer, preferably KETJENLUBE 1300; 10–25 volume percent of diester, preferably VISTONE A-30; 25–60 volume percent polyisobutylene, 10–30 volume percent of an aliphatic solvent such as kerosene; 1–5 volume percent of a detergent, preferably a calcium salt, and 0.5–2 volume percent of a combustion enhancer, preferably a manganese compound such as methylcyclopentadienyl manganese tricarbonyl. The two-cycle engine treatment composition may be added to the oil inlet of a two-cycle oil-injection motor, or may be blended with gasoline or other fuel (1 volume part two-cycle engine treatment to 10–100 volume parts fuel, preferably to about 50 parts fuel) and the blend used to power a two-cycle engine.

The various components of the engine treatment compositions described above will discussed in greater detail.

One component of the engine treatments is an ester copolymer (also referred to herein as "the copolymer"), which is the copolymerization product of an alpha-olefin and a dialkyl fumarate or dialkyl maleate. The copolymerization is preferably a random copolymerization. The alpha-olefin is preferably a $C_{6-18}$, more preferably a $C_{8-16}$, still more preferably a $C_{10-14}$ and yet still more preferably a $C_{12}$ alpha-olefin. The term alpha-olefin refers to a straight chain of the indicated number of carbon atoms, where a double bond is present between two end carbons, i.e., $C_6$ alpha-olefin has the formula $C_4$—CH═$CH_2$ while the $C_{12}$ alpha-olefin has the formula $C_{10}$—CH═$CH_2$.

As used herein, the designation $C_x$ or $C_{x-y}$ means a hydrocarbon containing X carbon atoms or X to Y carbon atoms, respectively, including straight chain or branched, saturated or unsaturated, cyclic or acyclic hydrocarbons.

The alkyl group of the dialkyl fumarate or maleate is a $C_{1-10}$ alkyl group, preferably a $C_{2-6}$ alkyl group and more preferably a $C_4$ alkyl group. Both of the fumarate and maleate contains two alkyl group, and these group may be the same or different in terms of carbon number. While either fumarate or maleate diesters are suited for the ester copolymer, fumarate diester is preferred.

The ester copolymer has an average molecular weight ($M_w$) of about 600 to about 7,000. The viscosity may be as high as about 700 $mm^2/s$ at 100° C., is preferably about 100–500 $mm^2/s$, and more preferably is about 200–300 $mm^2/s$.

Such ester copolymers may be prepared by free-radical polymerization techniques, as are known in the art. Alternatively, these ester copolymers may be obtained commercially. For example, a copolymer between $C_{12}$ alpha-olefin and dibutylfumarate is available under the trademark KETJENLUBE from Akzo Chemicals (Dobbs Ferry, N.Y.).

The ester copolymer serves to provide lubricity, anti-wear, dispersancy, extreme pressure and deposit control (engine cleanliness) properties to the inventive compositions. The ester copolymer may also be referred to as an anti-scuff agent.

Another component is a diester which, as its name implies, is a molecule formed from two ester groups. The diester is also referred to herein as "the diester oil," and has the formula $C_{2-24}$OC(═O)—$C_{2-10}$—C(═O)O—$C_{2-24}$, preferably has the formula $C_{6-20}$OC(═O)—$C_{2-8}$—C(═O)O—$C_{6-20}$, more preferably has the formula $C_{10-16}$OC(—O)—$C_{2-6}$—C(—O)O—$C_{10-16}$, and still more preferably has the formula $C_{13}$OC(—O)$C_4$C(—O)O $C_{13}$. Thus the diester is of fairly high molecular weight, preferably having at least about 20, more preferably at least about 30 carbon atoms, all of which are saturated and aliphatic.

Such diester oils may be prepared by condensation reaction between a dicarboxylic acid of the formula HOOC—$C_{2-10}$—COOH and a monohydric alcohol of the formula $C_{2-24}$—OH. Thus, the dicarboxylic acid and monohydric alcohol (or mixtures thereof) may be combined and heated until esterification is achieved, typically about 100–250° C. Such esterification reactions are well known in the art, and the starting materials (i.e., the dicarboxylic acid and the monohydric alcohol) are commercially available from, e.g., Aldrich Chemical Company (Milwaukee, Wis.).

The diester oils may also be purchased commercially. For example, ditridecyl adipate is available under the trademark VISTONE A-30 from Exxon Chemical (Houston, Tex.).

The diester oil serves to provide lubricity, anti-wear and deposit control properties to the inventive compositions. The diester oil may also be referred to as a synthetic base oil.

A further component is methylcyclopentadienyl manganese tricarbonyl (MCMT). MCMT is available commercially under the trademark ETHYL MMT from Ethyl Corporation (Richmond, Va.). MCMT serves to impart emission control to the inventive composition by aiding in the combustion of the oil-gasoline mixture, i.e., it serves as a combustion enhancer. MCMT serves to impart deposit control to the inventive composition by promoting complete combustion of the mixture, and can further assist in the removal of existing carbon deposits from exhaust ports and piston crowns. MCMT is typically an optional component in the inventive compositions, and other chemicals which can provide the combustion enhancement afforded by MCMT may be used in addition to, or in place of MCMT.

A further component is a base oil. Base oils typically contain detergent, solvent and hydrocarbon polymer, e.g., polyisobutylene. Such a mixture which contains polyisobutylene is available commercially under the trademark PARATEMPS 102 from Exxon Chemicals (Houston, Tex.).

Another component is a motor oil additive package. Such packages are commercially available, and serve to provide wear and deposit control to the inventive composition. Lubrizol (Wickliffe, Ohio) sells a motor oil additive package under their trademark LUBRIZOL 4994A, which may be used in the inventive composition.

Another component is a liquid hydrocarbon. When present in the inventive composition, the liquid hydrocarbon acts to lower the viscosity of the inventive composition and to lower its temperature pour. It also eases mixing of the inventive composition into gasoline. A suitable liquid hydrocarbon is kerosene. However, other liquid hydrocarbons of similar composition, e.g., jet fuel may be employed in the invention. Such liquid hydrocarbons are widely available from many commercial suppliers.

Another component is an Olefin Co-Polymer. The polymer compounds (Olefin Co-Polymers) are used as thickening agents. As used herein, a thickening agent is any substance which increases the viscosity of the composition. Such thickening agents include Nordel 4549, Lubrizol 7060A, Lubrizol 7065 and Paratone 715. The purpose of these thickeners is to provide rust and corrosion protection, keep the inventive composition on open gear surfaces (when used as on an open gear lube), and to add body or thicken lubricating oil that the inventive composition is mixed with.

A further component is an organo-molybdenum compound which contains a single molybdenum atom. The molybdenum atom is preferably complexed by a sulfur-containing ligand. Suitable ligands include thiophosphate and dithiocarbamate. Thus, molybdenum thiophosphate and molybdenum dithiocarbamate are suitable organo-molybdenum compounds for the inventive composition. These materials are commercially available. For example, molybdenum thiophosphate is available under the trademark MOLYVAN L from while molybdenum dithiocarbamate is available under the trademark MOLYVAN 822 from R. T. Vanderbilt Corporation (Norwalk, Conn.). Another suitable molybdenum compound is 2-ethylhexyl molybdenum dithiophosphate, which is commercially available as ADDITIN RC 3580 from Rhein Chemie (Trenton, N.J.).

Another component is a bismuth complex. An exemplary bismuth complex is bismuth naphthenate, which is available commercially as LIOVAC 3016 and is made by Miracema-Nuodex Industries, Ltd., Campinas-SP, Brazil.

The organo-molybdenum and/or the bismuth complex serves to provide lubricity, anti-wear and anti-oxidant properties to the inventive composition.

A further component is dimercapto, 1,3,4 thiadiazole. This material is commercially available under the trademark AMOCO 158 from The Ethyl Corporation (Orange, Calif.), VANLUBE 871 from R. T. Vanderbilt Corporation (Norwalk, Conn.) and ADDITIN TC 8210 from Rhein Chemie (Trenton, N.J.). The dimercapto, 1,3,4 thiadizole serves to impart anti-wear, extreme pressure and anti-corrosion performance properties to the inventive composition.

Another component is sulfur-phosphorous EP and/or chlorinated paraffin. Either of these materials, or the combination thereof, serves to provide extreme pressure and anti-wear properties to the inventive composition. Sulfur-phosphorous EP is also known as sulfur phosphorous gear oil, and is commercially available under the trademark ANGLAMOL 6043 from Lubrizol Corp. (Wickliffe, Ohio) while chlorinated paraffin is commercially under the trademark PAROIL 50L50 from Dover Chemical Corporation (Dover, Ohio).

A further component is a fullerene rich oil. Such an oil may be prepared by dissolving fullerene powder in a naphthenic base oil. In order to prepare the Fullerene Rich Oil, Fullerene Rich Soot or Pure Fullerene Compounds may be purchased from Texas Fullerenes Company (Houston, Tex.), or Fluka. The Fullerene Rich Soot is added to Benzene. The soot does not dissolve, however the Fullerenes will. Decant Benzene Fullerene mixture, and dry to obtain "pure" Fullerene compound. Add this compound to Naphthetic 60 Second Oil or equivalent. 60 Second Oil can be purchased from Shell (Portland, Oreg.) or Witco (Los Angeles, Calif.). Typically 2 grams of Fullerene material is added to 2 gallons of 60 Second Oil. However, as little as about 0.2 grams and as much as about 20 grams of the Fullerene material could be added to the 2 gallons of 60 Second Oil.

A further component is mineral oil. A suitable mineral oil has about 200 to about 600 SUS at 100° F., and preferably has 450 SUS at 100° F. Such mineral oil is commercially available. For example, mineral oil with 450 SUS at 100° F. is available under the trademark HVI 450 NEUTRAL from Mohawk Lubricants (North Vancouver B.C., Canada). Similar products are available from Chevron, U.S.A. (Richmond, Calif.) and Exxon U.S.A. (Houston, Tex.).

It is sometimes useful to incorporate to any of the aforedescribed anti-wear concentrate, SLC engine treatment or two-cycle engine treatment, on an optional, as needed basis, other known additives which include, but are not limited to, dispersants and detergents of the ash-producing or ashless type, antioxidants, anti-wear agents, extreme pressure agents, emulsifiers, demulsifiers, foam inhibitors, friction modifiers, anti-rust agents, corrosion inhibitors, viscosity improvers, pour point depressants, dyes, lubricity agents, and solvents to improve handleability which may include alkyl and/or aryl hydrocarbons. These optional additives may be present in various amounts depending on the intended application for the final product or may be excluded therefrom.

The ash-containing detergents are the well-known neutral or basic Newtonian or non-Newtonian, basic salts of alkali, alkaline earth and transition metals with one or more hydrocarbyl sulfonic acid, carboxylic acid, phosphoric acid, mono- and/or dithio phosphoric acid, phenol or sulfur coupled phenol, and phosphinic and thiophosphinic acid. Commonly used metals are sodium, potassium, calcium, magnesium, lithium, copper and the like. Sodium and calcium are most commonly used.

Neutral salts contain substantially equivalent amounts of metal and acid. As used herein, the expression basic salts refers to those compositions containing an excess amount of metal over that normally required to neutralize the acid substrate. Such basic compounds are frequently referred to as overbased, superbased, etc.

Dispersants include, but are not limited to, hydrocarbon substituted succinimides, succinamides, carboxylic esters, Mannich dispersants and mixtures thereof as well as materials functioning both as dispersants and viscosity improvers. The dispersants include nitrogen-containing carboxylic dispersants, ester dispersants, Mannich dispersants or mixtures thereof. Nitrogen-containing carboxylic dispersants are prepared by reacting a hydrocarbyl carboxylic acylating agent (usually a hydrocarbyl substituted succinic anhydride) with an amine (usually a polyamine). Ester dispersants are prepared by reacting a polyhydroxy compound with a hydrocarbyl carboxylic acylating agent. The ester dispersant may be further treated with an amine. Mannich dispersants are prepared by reacting a hydroxy aromatic compound with an amine and aldehyde. The dispersants listed above may be post-treated with reagents such as urea, thiourea, carbon disulfide, aldehydes, ketones, carboxylic acids, hydrocarbon substituted succinic anhydride, nitrites, epoxides, boron compounds, phosphorus compounds and the like. These dispersants are generally referred to as ashless dispersants even though they may contain elements such as boron or phosphorus which, on decomposition, will leave a non-metallic residue.

Extreme pressure agents and corrosion- and oxidation-inhibiting agents include chlorinated compounds, sulfurized compounds, phosphorus containing compounds including, but not limited to, phosphosulfurized hydrocarbons and phosphorus esters, metal containing compounds and boron containing compounds.

Chlorinated compounds are exemplified by chlorinated aliphatic hydrocarbons such as chlorinated wax.

Examples of sulfurized compounds are organic sulfides and polysulfides such as benzyl disulfide, bis(-chlorobenzyl) disulfide, dibutyl tetrasulfide, sulfurized methyl ester of oleic acid, sulfurized alkylphenol, sulfurized dipentene, and sulfurized terpene.

Phosphosulfurized hydrocarbons include the reaction product of a phosphorus sulfide with turpentine or methyl oleate.

Phosphorus esters include dihydrocarbon and trihydrocarbon phosphites, phosphates and metal and amine salts thereof.

Phosphites may be represented by the following formulae:

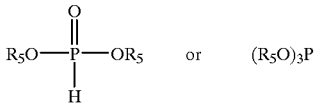

wherein each $R_5$ is independently hydrogen or a hydrocarbon based group, provided at least one $R_5$ is a hydrocarbon based group.

Phosphates esters include mono-, di- and trihydrocarbon-based phosphates of the general formula $$(R_5O)_3PO.$$

Examples include mono-, di- and trialkyl; mono-, di- and triaryl and mixed alkyl and aryl phosphates.

Metal containing compounds include metal thiocarbamates, such as zinc dioctyldithiocarbamate, and barium heptylphenyl dithiocarbamate, and molybdenum compounds.

Boron containing compounds include borate esters and boron-nitrogen containing compounds prepared, for example, by the reaction of boric acid with a primary or secondary alkyl amine.

Viscosity improvers include, but are not limited to, polyisobutenes, polymethacrylate acid esters, polyacrylate acid esters, diene polymers, polyalkyl stryrenes, alkenyl aryl conjugated diene copolymers, polyolefins and multifunctional viscosity improvers.

Pour point depressants are a particularly useful type of additive often included in the lubricating oils described herein. See, for example, page 8 of "Lubricant Additives" by C. V. Smalheer and R. Kennedy Smith (Lesius-Hiles Company Publishers, Cleveland, Ohio, 1967).

Lubricity agents include synthetic polymers (e.g., polyisobutene having a number of average molecular weight in the range of about 750 to about 15,000, as measured by vapor phase osmometry or gel permeation chromatography), polyolether (e.g., poly(oxyethylene-oxypropylene ethers) and ester oils. Natural oil fractions such as bright stocks (the relatively viscous products formed during conventional lubricating oil manufacture from petroleum) can also be used for this purpose. They are usually present, when used in two-cycle oils, in amounts of about 3% to about 20% by volume of the total composition.

Diluents include such materials as petroleum naphthas boiling in the range of 30° to about 90° C. (e.g., Stoddard Solvent). When used, they are typically present in amounts ranging from about 5% to about 25% by volume.

Anti-foam agents used to reduce or prevent the formation of stable foam include silicones or organic polymers. Examples of these and additional anti-foam compositions are described in "Foam Control Agents," by Henry T. Kerner (Noyes Data Corporation, 1976), pages 125–162.

These and other additives are described in greater detail in U.S. Pat. No. 4,582,618 (column 14, lines 52 through column 17, line 16, inclusive), herein incorporated by reference for its disclosure of other additives that may be used in the compositions of the present invention.

The components may be blended together in any suitable manner and then admixed, for example with a diluent to form a concentrate as discussed below, or with a lubricating oil, as discussed below. Alternatively, components can be admixed separately with such diluent or lubricating oil. The blending technique for mixing the components is not critical and can be effected using any standard technique, depending upon the specific nature of the materials employed. In general, blending can be accomplished at room temperature; however, blending can be facilitated by heating the components.

As previously indicated, the two-cycle engine treatment compositions of the present invention are useful as additives for lubricants for two-cycle engines. They can be employed in a variety of lubricant basestocks comprising diverse oils of lubricating viscosity, including natural and synthetic lubricating oils and mixtures thereof.

Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrhydrofurans, silicon-based oils and mixtures thereof.

Specific examples of oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Base Oils," *Lubrication Engineering,* volume 43, pages 184–185, March, 1987. This article is herein incorporated by reference for its disclosures relating to lubricating oils. A description of oils of lubricating viscosity occurs in U.S. Pat. No. 4,582,618 (column 2, line 37 through column 3, line 63, inclusive), herein incorporated by reference for its disclosure to oils of lubricating viscosity.

As is well known to those skilled in the art, two-cycle engine lubricating oils are often added directly to the fuel to form a mixture of a lubricant and fuel which is then introduced into the engine cylinder. Such lubricant-fuel mixtures are within the scope of this invention. Such lubricant-fuel mixtures generally contain a major amount of fuel and a minor amount of lubricant, more often at least about 10, preferably about 15, more preferably about 20 up to about 100, more preferably up to about 50 parts of fuel per 1 part of lubricant.

The fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ether, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Mixtures of fuels, such as mixtures of gasoline and alcohol, for example, methanol or ethanol are among the useful fuels.

Examples of fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Natural gas is also useful as a fuel for two-cycle engines.

Two-cycle fuels also contain other additives which are well known to those of skill in the art. These may include ethers, such as ethyl-t-butyl ether, methyl-t-butyl ether and the like, alcohols such as ethanol and methanol, lead scavengers such as halo-alkanes (e.g., ethylene dichloride and ethylene dibromide), dyes, certain improvers, antioxidants such as 2,6 di-tertiary-butyl-4-methylphenol, rust inhibitors, such as alkylated succinic acids and anhydrides, bacteriostatic agents, gum inhibitors, metal deactivators, demulsifiers, upper cylinder lubricants, anti-icing agents and the like. The invention is useful with lead-free as well as lead-containing fuels.

The following examples are offered for purposes of illustration, not limitation.

EXAMPLES

Example 1

Preparation and Evaluation of SLC Engine Treatment

An SLC (synthetic lubricant concentrate) engine treatment was prepared by mixing together the ingredients listed to form Formula A of Table 1.

TABLE 1

| Ingredients for Formula A | % Volume |
|---|---|
| Vistone A-30 | 5.0 |
| Molyvan L | 16.0 |
| Paranox 1560 | 15.0 |
| Vegetable Base SP Chemistry ILI Lube Gard | 10.0 |
| Paroil 50L50 | 12.0 |
| Fullerene Concentrate | 2.0 |
| HVI450 Neutral Mineral Oil | 40.0 |

Bench Wear, Deposit and Oxidation testing found Formula A of Table 1 to have excellent wear, extreme pressure, deposit, oxidation, and corrosion benefits, as shown by the results presented in the following Tables 2–6.

TABLE 2

MODIFIED TIMKEN TESTING*

| Lubricant Sample | Wear Scar Length | Seizure Load in Pounds |
|---|---|---|
| Sequence II D Fail | 8 mm | 6 |
| Sequence III D Pass | 6 mm | 8 |
| Commercial SH Motor Oil | 6 mm | 9 |
| Sequence III D Fail + Formula A | 4 mm | 25 |
| Commercial SH Motor Oil + Formula A | 4 mm | 31 |

*Modified Timken testing has been used as cam and follower wear screening test for motor oils (SAE Paper k#840264). III D Fail oil had high engine wear in the Sequence III D test used to evaluate motor oils for engine wear protection. The III D Pass oil met the war performance characteristics specified in the III D test. These reference oils were used as oxidation test reference oils as well. Sequence II D Fail and Sequence III D Pass lubricants are described in the SAE paper. The Commercial SH Motor oil is a typically motor oil sold to the public for 4-cycle engines.

TABLE 3

ASTM D-3233 (FALEX PIN-ON-VEE BLOCK TEST)#

| Load in Pounds | Motor Oil A Torque | Motor Oil B Torque | Motor Oil A + Formula A Torque |
|---|---|---|---|
| 300 | 13 | 13 | 13 |
| 1100 | 100 | 48 | 40 |
| 1400 | | 100 | 46 |
| 2000 | | | 60 |
| 2400 | | | 69 |
| 2800 | | | 78 |
| 3000 | | | 80 |

#Motors Oils A and B are described in the ASTM procedure.

TABLE 4

4-BALL EP TESTING⊕

| Load | SH Motor Oil-Wear Scar | SH Motor Oil + Formula A-Wear Scar |
|---|---|---|
| 180 kilograms | 2700 microns | 2500 microns |
| 200 kilograms | 3000 microns | 2600 microns |
| 220 kilograms | Weld | 3000 microns |
| 240 kilograms | | Weld |

⊕The SH Motor Oil was a formulated motor oil commercially available to the public for addition to four-cycle automobile engines.

TABLE 5

COPPER CORROSION ASTM D-130∅

| Lubricant Sample | Result |
|---|---|
| Reference Oil | 1B |
| Reference Oil + Formula A | 2A |

∅The Reference Oil is described in the ASTM procedure.

TABLE 6

BARDAHL MOTOR OIL OXIDATION TEST℘

| Lubricant Sample | Oxidation As Viscosity Increase @ 100° C. | Copper Coupon Wt. Loss | Brass Coupon Wt. Loss |
|---|---|---|---|
| III D Pass | 50% | 0.05% | 0.25% |
| III D Fail | 210% | 0.12% | 3.50% |
| III D Fail + Formula A | 182% | 0.35% | 0.15% |

℘The Bardahl Motor Oil Oxidation-Corrosion Test is based on ASTM D 943 and International Harvester procedure #BT-10. These procedures have been modified to adapt the test to use with typical motor oil lubricants. Reference oils from engine tests Sequence III-D and III-E have been used to calibrate the test. The Bardahl procedure bubbles dry air through an oil sample heated to135° C. for 500 hours in the presence of steel, brass, aluminum, and copper coupons. Bardahl testing with reference oils indicates the test discriminates between oils of high oxidation and "yellow metal" corrosion potential and oils with moderate to low oxidation and "yellow metal" corrosion potential. "Yellow metal" is defined as alloys containing copper.

Raw Material Sources:

Amoco 158 (Hitec 4313) The Ethyl Corporation, Orange, Calif., 92668

Vanlube 871 and Vanlube 7611, R. T. Vanderbilt Corporation, Norwalk, Conn., 06855

Additin RC 8210, Rhein Chemie, Trenton, N.J., 06638

Lubrizol 4994A, Anglamol 6043, and Lubrizol 1395, The Lubrizol Corporation, Wickliffe, Ohio, 44092

Paranox 15, Parapoid 7205, Vistone A-30, and Paranox 1560, Paramins (Exxon Chemical Corporation), Linden, N.J., 07036

Fullerene Powder, Texas Fullerenes Company, Houston, Tex., or Fluka, or Fluka Chemie, Germany, or SES Research Inc., Houston, Tex., or Southern Chemical Group, Stone Mountain, Ga.

Elco 7, Elco Corporation, 1000 Belt Line Street, Cleveland, Ohio, 4419-2800

Mobilad G-201, Mobil Chemical Corporation, P.O. Box 3140, Edison, N.J., 08818-3140

Lubegard Vegetable Oil Sulfur—Phosphorus Additive, International Lubricants Inc., Seattle, Wash.

HVI 150, HVI 450 Neutral Oils, Mohawk Lubricants, North Vancouver, V.C., Canada (oils also available from Chevron USA, Richmond, Calif. and EXXON USA, Houston, Tex.)

Ketjenlube 1300, Akzo Chemical, Dobbs Ferry, N.Y., 10522

Paroil 50L50 (Chlorinated Paraffin), Dover Chemical Corporation, Dover, Ohio

Example 2

Preparation and Evaluation of SLC Engine Treatment

An SLC engine treatment was prepared by mixing together the ingredients listed to form Formula B of Table 7.

TABLE 7

| Ingredients for Formula B | % Volume |
|---|---|
| Ketjenlube 1300 | 5.0 |
| Molyvan 822 | 16.0 |
| Lubrizol 4994A | 15.0 |
| Amoco 158 | 5.0 |
| Angalmol 6043 | 15.0 |
| Fullerene Concentrate | 2.0 |
| HVI 450 Neutral Mineral Oil | 42.0 |

Formula B of Table 7 was evaluated according to the procedures set forth in Example 1, the results of which are presented in the following Tables 8–10.

TABLE 8

MODIFIED TIMKEN TESTING

| Lubricant Sample | Wear Scar Length | Seizure Load in Pounds |
|---|---|---|
| Sequence III D Fail | 8 mm | 6 |
| Sequence III D Pass | 6 mm | 8 |
| Commercial SH Motor Coil | 6 mm | 9 |
| Sequence III D Fail + Formula B | 4 mm | 30 |
| Commercial SH Motor Oil + Formula B | 3.5 mm | 31 |

TABLE 9

COPPER CORROSION ASTM D-130

| Lubricant Sample | Result |
|---|---|
| Reference Oil | 1B |
| Reference Oil + 2% Formula D | 1A |

TABLE 10

4-BALL EP TESTING

| Load | SH Motor Oil-Wear Scar | SH Motor Oil + Formula B-Wear Scar |
|---|---|---|
| 180 kilograms | 2700 microns | 2450 microns |
| 200 kilograms | 3000 microns | 2550 microns |
| 220 kilograms | Weld | 2850 microns |
| 240 kilograms | | Weld |

Example 3

Preparation and Evaluation of SLC Engine Treatment

An SLC engine treatment was prepared by mixing together the ingredients listed in Table 11 to form Formula C.

TABLE 11

| Ingredients for Formula C | % Volume |
|---|---|
| Ketjenlube 1300 | 5.0 |
| Molyvan 822 | 12.0 |
| Lubrizol 4994A | 15.0 |
| Amoco 158 | 5.0 |
| Angalmol 6043 | 15.0 |

TABLE 11-continued

| Ingredients for Formula C | % Volume |
|---|---|
| Lubrizol 1395 or Paranox 15 | 4.0 |
| Fullerene Concentrate | 2.0 |
| HVI 450 Neutral Mineral Oil | 42.0 |

Formula C Of Table 11 was evaluated according to the procedures set forth in Example 1, the results of which are presented in the following Tables 12–14.

TABLE 12

MODIFIED TIMKEN TESTING

| Lubricant Sample | Wear Scar Length | Seizure Load in Pounds |
|---|---|---|
| Sequence III D Fail | 8.0 mm | 6 |
| Sequence III D Pass | 6.0 mm | 8 |
| Commercial SH Motor Oil | 6.0 mm | 9 |
| Sequence III D Fail + Formula C | 3.5 mm | 32 |
| Commercial SH Motor Oil + Formula C | 3.0 mm | 32 |

TABLE 13

COPPER CORROSION ASTM D-130

| Lubricant Sample | Result |
|---|---|
| Reference Oil | 1B |
| Reference Oil + Formula D | 1A |

TABLE 14

4-BALL EP TESTING

| Load | SH Motor Oil-Wear Scar | SH Motor Oil + Formula C-Wear Scar |
|---|---|---|
| 180 kilograms | 2700 microns | 2450 microns |
| 200 kilograms | 3000 microns | 2550 microns |
| 220 kilograms | Weld | 2700 microns |
| 240 kilograms | | 2900 microns |
| 260 kilograms | | 3100 microns |
| 280 kilograms | | Weld |

Example 4

Preparation and Evaluation of Additive Concentrate

An additive concentrate having Formula D of Table 15 was prepared by combining the ingredients set forth in Table 15. Field testing and laboratory bench testing show that Formula D of Table 15 has excellent corrosion protection and oxidation, wear and friction reduction properties. Ketjenlube 1300 provides synergistic anti-wear and extreme pressure properties to Formula D. Use of Ketjenlube 1300 at from about 2.0 to 10.0 volume percent is preferred. Ketjenlube 1300 also provides dispersancy and engine cleanliness benefits.

TABLE 15

| Ingredients for Formula D | % Volume |
|---|---|
| Ketjenlube 1300 | 5.0 |
| Molyvan 822 or Molyvan L | 35.0 |
| Amoco 158 | 6.0 |
| Angalmol 6043 or Parapoid 7205 or Vanlube 7611 | 45.0 |
| Fullerene Concentrate | 2.0 |
| HVI 150 Neutral Mineral Oil | 7.0 |

Formula D of Table 15 was evaluated according to the procedures set forth in Example 1, the results of which are presented in the following Tables 16–17.

TABLE 16

MODIFIED TIMKEN TESTING

| Lubricant Sample | Wear Scar Length | Seizure Load in Pounds |
|---|---|---|
| Sequence III D Fail | 8.0 mm | 6 |
| Sequence III D Pass | 6.0 mm | 8 |
| Commercial SH Motor Oil | 6.0 mm | 9 |
| Sequence III D Fail + Formula B | 4.0 mm | 28 |
| Commercial SH Motor Oil + Formula D | 3.8 mm | 30 |

TABLE 17

COPPER CORROSION ASTM D-130

| Lubricant Sample | Result |
|---|---|
| Reference Oil | 1B |
| Reference Oil + 2% Formula D | 1B |

The inventive additive concentrate provides for the following benefits: (1) Use of normally corrosive anti-wear agents in a compound that is not corrosive. (2) Formation of a friction fighting film that is effective and long lasting. (3) Formation of deposit removing film. (4) Control of oil oxidation in 2 and 4 cycle engines.

Example 5

Preparation and Evaluation of an Additive Concentrate

The below formulas for an additive concentrate similar to Formula D of Example 4 were prepared. These compounds have the advantage of low odor The "modified Timken" performance of the formulas is very similar to other anti-wear concentrates noted. These compounds were evaluated, the results of which are presented in the following Tables 18–21.

TABLE 18

LOW ODOR ANTI-WEAR CONCENTRATE Y

| Ingredients | % Volume |
|---|---|
| Ketjenlube 1300 | 40.0 |
| Molyvan 822 | 10.0 |
| Lubrizol 1395 or Paranox 15 | 15.0 |
| Fullerene Concentrate | 5.0 |
| Vistone A-30 or Vistone A-10 | 30.0 |

TABLE 19

MODIFIED TIMKEN TESTING

| Lubricant Sample | Wear Scar Length | Seizure Load in Pounds Force |
|---|---|---|
| Sequence III D Fail | 8.0 mm | 6 |
| Sequence III D Pass | 6.0 mm | 8 |
| Commercial SH Motor Oil | 6.0 mm | 9 |
| Commercial SH Motor Oil + Formula Y | 4.0 mm | 32 |

TABLE 20

LOW ODOR ANTI-WEAR CONCENTRATE Z

| Ingredients | % Volume |
|---|---|
| Ketjenlube 1300 | 45.0 |
| Molyvan 822 | 10.0 |
| Lubrizol 1395 or Paranox 15 | 20.0 |
| Fullerene Concentrate | 5.0 |
| HVI 150 Neutral | 20.0 |

TABLE 21

MODIFIED TIMKEN TESTING

| Lubricant Sample | Wear Scar Length | Seizure Load in Pounds Force |
|---|---|---|
| Sequence III D Fail | 8.0 mm | 6 |
| Sequence III D Pass | 6.0 mm | 8 |
| Commercial SH Motor Oil | 6.0 mm | 9 |
| Commercial SH Motor Oil + Formula Z | 3.9 mm | 19 |

Example 6

Preparation and Evaluation of SLC Engine Treatment

An SLC engine treatment was prepared by mixing together the ingredients listed in Table 21 to form Formula E.

TABLE 22

| Ingredients for Formula E | % Volume |
|---|---|
| Ketjenlube 1300 | 5.0 |
| Molyvan 822 or Molyvan L | 35.0 |
| Amoco 158 | 6.0 |
| Paroil 50L50 | 35.0 |
| Fullerene Concentrate | 2.0 |
| HVI 150 Neutral Mineral Oil | 17.0 |

Evaluation of Formula E of Table 22 as described in Example 1 provided the following results presented in Tables 23–24.

TABLE 23

| MODIFIED TIMKEN TESTING | | |
|---|---|---|
| Lubricant Sample | Wear Scar Length | Seizure Load in Pounds |
| Sequence III D Fail | 8.0 mm | 6 |
| Sequence III D Pass | 6.0 mm | 8 |
| Commercial SH Motor Oil | 6.0 mm | 9 |
| Sequence III D Fail + Formula E | 3.8 mm | 32 |
| Commercial SH Motor Oil + Formula E | 3.2 mm | 32 |

TABLE 24

| COPPER CORROSION ASTM D-130 | |
|---|---|
| Lubricant Sample | Result |
| Reference Oil | 1B |
| Reference Oil + 2% Formula E | 2A |

Example 7

Preparation and Evaluation of SLC Engine Treatment

An SLC engine treatment was prepared by mixing together the ingredients listed in Table 24 to form Formula F.

TABLE 25

| Ingredients for Formula F | % Volume |
|---|---|
| Kenjenlube 1300 | 5.0 |
| Molyvan 822 or Molyvan L | 15.0 |
| Amoco 158 | 4.0 |
| Angalmol 6043 or Parapoid 7205 or Vanlube 7611 | 55.0 |
| Lubrizol 1395 or Paranox 15 | 4.0 |
| Fullerene Concentrate | 2.0 |
| HVI 150 Neutral Mineral Oil | 15.0 |

Evaluation of Formula F as described in Example 1 provided the following results presented in Tables 26–27.

TABLE 26

| MODIFIED TIMKEN TESTING | | |
|---|---|---|
| Lubricant Sample | Wear Scar Length | Seizure Load in Pounds |
| Sequence III D Fail | 8.0 mm | 6 |
| Sequence III D Pass | 6.0 mm | 8 |
| Commercial SH Motor Oil | 6.0 mm | 9 |
| Sequence III D Fail + Formula F | 3.5 mm | 32 |
| Commercial SH Motor Oil + Formula F | 3.0 mm | 32 |

TABLE 27

| COPPER CORROSION ASTM D-130 | |
|---|---|
| Lubricant Sample | Result |
| Reference Oil | 1B |
| Reference Oil + 2% Formula F | 1A |

Example 8

Synthetic Two-Cycle Engine Treatment

A synthetic two-cycle engine treatment having Formula G was prepared by mixing together the ingredients and proportions as set forth in Table 28. Performance properties are set forth in Table 33.

TABLE 28

| Ingredients for Formula G | % Volume |
|---|---|
| Ketjenlube 1300 | 10.0 |
| Vistone A-30 | 20.0 |
| Paratemps 102 | 40.0 |
| Jet Fuel | 28.0 |
| Fullerene Concentrate | 1.0 |
| MMT (Ethyl Corporation) | 1.0 |

Example 9

Synthetic Two-Cycle Engine Treatment

A synthetic two-cycle engine treatment having Formula H was prepared by mixing together the ingredients and proportions as set forth in Table 29. Performance properties are set forth in Table 33.

TABLE 29

| Ingredients for Formula H | % Volume |
|---|---|
| Ketjenlube 1300 | 10.0 |
| Vistone A-30 | 20.0 |
| Paratemps 102 | 40.0 |
| Jet Fuel | 29.0 |
| MMT (Ethyl Corporation) | 1.0 |

Example 10

Synthetic Two Cycle Engine Treatment

A synthetic two-cycle engine treatment having Formula I was prepared by mixing together the ingredients and proportions as set forth in Table 30. Performance properties are set forth in Table 33.

TABLE 30

| Ingredients for Formula I | % Volume |
|---|---|
| Ketjenlube 1300 | 10.0 |
| Vistone A-30 | 20.0 |
| Paratemps 101A | 6.0 |
| Paratemps 54 | 30.0 |
| Parabar 1009 | 4.0 |
| Jet Fuel | 29.0 |
| MMT (Ethyl Corporation) | 1.0 |

Example 11

Synthetic Two-Cycle Engine Treatment

A synthetic two-cycle engine treatment having Formula J was prepared by mixing together the ingredients and proportions as set forth in Table 31. Performance properties are set forth in Table 33.

TABLE 31

| Ingredients for Formula J | % Volume |
|---|---|
| Ketjenlube 1300 | 10.0 |
| Vistone A-30 | 20.0 |
| Lubrizol 600 | 9.0 |
| Lubrizol 3108 | 30.0 |
| Jet Fuel | 29.5 |
| MMT (Ethyl Corporation) | 1.5 |

A synthetic two-cycle engine treatment having Formula K in Table 32 was prepared by mixing together the ingredients and proportions as set forth in Table 32.

TABLE 32

| Ingredients for Formula K | % Volume |
|---|---|
| Ketjenlube 1300 | 10.0 |
| Vistone A-30 | 20.0 |
| PCA 31110 FC | 55.0 |
| Jet Fuel | 13.5 |
| MMT (Ethyl Corporation) | 1.5 |

TABLE 33

HOT TUBE TESTING—SYNTHETIC TWO-CYCLE ENGINE TREATMENT FORMULA

| Lubricant Sample | Hot Tube Test Rating 10 = No Deposits; 1 = Very Heavy Deposits |
|---|---|
| Commercial Oil | 3.2 |
| Low Smoke Reference Oil | 3.0 |
| LS Reference + Formula G | 4.2 |
| LS Reference + Formula H | 4.5 |
| LS Reference + Formula I | 4.5 |
| LS Reference + Formula J | 4.4 |

Raw Material Sources

MMT, The Ethyl Corporation, Orange, Calif. 92668

Lubrizol 600 and Lubrizol 3108, The Lubrizol Corporation, Wickliffe, Ohio, 44092

Paratemps 101A, 102, Paratemps 54, Parabar 10009, Paramins (Exxon Chemical Corporation), Linden, N.J., 07036

PCA 3110 FC, Soltex, Petroleum Chemicals Company, 3011 Citrus Circle, Suite 202, Walnut Creek, Calif.

Fullerene Powder, Texas Fullerenes Company, Houston, Tex., or Fluka Chemie, Germany, or SES Research Inc., Houston, Tex., or Southern Chemical Group, Stone Mountain, Ga.

Ketjenlube 1300, Akzo Chemical, Dobbs Ferry, N.Y., 10522

Jet Fuel (a.k.a. Kerosene), Chevron, Richmond, Calif., Lilyblad Petroleum, Tacoma, Wash.

Example 12

Preparation and Evaluation of SLC Gear Oil Treatment

SLC (synthetic lubricant concentrate) gear oil treatments were prepared by mixing together the ingredients listed in Tables 34, 35 and 36 to form Formulas L, M and N, respectively.

TABLE 34

| Ingredients Formula L | % Volume |
|---|---|
| Vistone A-30 | 5.0 |
| Fullerene Concentrate | 2.0 |
| Bismuth Naphthenate | 93.0 |

TABLE 35

| Ingredients Formula M | % Volume |
|---|---|
| Vistone A-30 | 5.0 |
| Bismuth Naphthenate | 95.0 |

TABLE 36

| Ingredients Formula N | % Volume |
|---|---|
| Vistone A-30 or Ketjenlube 1300 | 5.0 |
| Amoco 158 | 2.0 |
| Fullerene Concentrate | 2.0 |
| Bismuth Naphthenate | 91.0 |

Bench wear and deposit—oxidation testing found Formulas L, M and N to impart superior wear, extreme pressure, deposit, oxidation, and corrosion benefits, as shown by the data presented in Tables 37 and 38.

TABLE 37

4-BALL EP TESTING*

| Lubricant | Weld Load | Load Wear Index |
|---|---|---|
| Commercial Gear Oil A | 400 kilograms | 61.6 |
| Commercial Gear Oil A + 2.5% by volume Formula L | 800 kilograms | 102.0 |
| Commercial Gear Oil F + 2.3% by volume Formula L | 800 kilograms | 107.2 |
| Commercial Gear Oil F | 400 kilograms | 72.9 |
| Commercial Gear Oil F + 2.3% by volume Formula M | 800 kilograms | 101.4 |
| Commercial Gear Oil F + 2.3% by volume Formula N | 800 kilograms | 105.6 |

*The 4-Ball EP test (ASTM D-2793) measures the extreme pressure properties of lubricants. Gear Oils of API GL-5 quality typically have a Weld Load of 400 kilograms or lower. The addition of low levels of the SLC Gear Treatment increased weld and load wear index values significantly. Other compounds based on lead and chlorine can achieve somewhat similar results (see 4-Ball EP Testing Table 2) but these compounds pose health and environmental risks. In many cases these compounds are prevented from being sold by specific legislation.

TABLE 38

4-BALL EP TESTING

| Lubricant | Weld Load | Load Wear Index |
|---|---|---|
| Commercial Gear Oil C | 400 kilograms | 67.4 |
| Commercial Gear Oil A + 2.0% by volume Lead Naphthenate 1.5% Chlorinated Paraffin | 620 kilograms | 87.5 |
| Commercial Gear Oil C + 3% Bismuth Naphthenate | 800 kilograms | 91.5 |
| Commercial Gear Oil C + 2.3% by volume Formula L | 800 kilograms | 104.5 |

Raw Material Sources

Fullerene Powder, Texas Fullerenes Company, Houston, Tex., or Fluka Chemie, Germany, or SES Research Inc., Houston, Tex., or Southern Chemical Group, Stone Mountain, Ga.

Ketjenlube 1300, Akzo Chemical, Dobbs Ferry, N.Y., 10522

Vistone A-30, and Vistone A-10 Paramins (Exxon Chemical Corporation), Linden, N.J., 07036

HVI 150, HVI 450 Neutral Oils, Mohawk Lubricants, North Vancouver, B. C., Canada (oils also available from Chevron USA, Richmond, Calif. and EXXON USA, Houston, Tex.).

Jet Fuel (a.k.a. Kerosene), Chevron, Richmond, Calif., Lilyblad Petroleum, Tacoma, Wash.

Bismuth Naphthenate, Liovac 3016 Miracema Nuodex, Sao Paulo, Brazil or OMG Corporation, Franklin, Pa., 16323.

The composition described in Tables 34 and 35 may also be used as a grease anti-wear, extreme pressure additive, as shown by the results presented in Table 39. 4-Ball EP testing in a commercial, lithium based, extreme pressure grease at 2 percent by volume demonstrated the anti-wear and extreme pressure performance of the invention. Addition of the invention compositions increased the performance of the commercial grease to levels that exceeded those of commercial, premium, extreme pressure—anti-wear grease products.

TABLE 39

4-BALL EP TESTING

| Grease Sample | Wear Scar @ 160 kg | Wear Scar @ 180 kg | Wear Scar @ 200 kg |
|---|---|---|---|
| Special EP Gear Grease | 1350 microns | 1425 microns | 1740 microns |
| Moly-Graphite Grease | 1650 microns | 1560 microns | 1950 microns |
| Lithium Complex EP Grease | 1800 microns | 1850 microns | 2250 microns |
| Lithium EP reference Grease | 2100 microns | 2400 microns | 3000 microns |
| Reference Grease + 2% Formula L | 1425 microns | 1500 microns | 1800 microns |
| Reference Grease + 2% Formula M | 1550 microns | 1650 microns | 2050 microns |

A complete SLC, high viscosity, gear oil and engine treatment was prepared by mixing together the ingredients listed in Table 40 to form Formula O. This formula can be used as complete gear oil, as a gear oil treatment, or as a high viscosity oil treatment. This embodiment of the SLC formula has superior extreme pressure, anti-wear and anti-friction characteristics. The formula also provides added lubricant stability and minimizes oil consumption characteristics of engine lubricants when it is combined.

TABLE 40

| Ingredients Formula O | % Volume |
|---|---|
| Vistone A-30 or Ketjenlube 1300 | 1.0 |
| Fullerene Concentrate | 2.0 |
| Bismuth Naphthenate | 2.0 |
| Olefin Co-Polymer (Nordel 4549 or Lubrizol 7060A or Lubrizol 7065 or Paratone 715) | 4.0 |
| HVI 150 Neutral | 80.0 to 84.0 |
| Molyvan 822 or Molyvan L or | 2.0 to 3.0 |
| Amoco 158 or | 1.0 to 3.0 |

TABLE 40-continued

| Ingredients Formula O | % Volume |
|---|---|
| Anglamol 6043 or Anglamol 99 or Parapoid 7205 or Elco 7 or Mobilad G-251 | 5.5 to 8.5 |

Table 41 summarizes testing of formulas L, M, N and O with reference gear oil.

TABLE 41

BARDAHL MOTOR AND GEAR OXIDATION AND CORROSION TEST

| Sample | Oxidation | Copper Corrosion | Brass Corrosion |
|---|---|---|---|
| 80W90 Reference Gear Oil | 1.00 | 1.00 | 1.00 |
| Reference Oil + 2.3% Formula L | 1.30 | 1.10 | 1.03 |
| Reference Oil + 2.3% Formula M | 1.40 | 1.20 | 1.05 |
| Reference Oil + 2.3% Formula N | 1.03 | 0.85 | 0.95 |
| Reference Oil + 10% Formula O | 1.05 | 0.79 | 1.00 |
| Formula O | 1.00 | 0.67 | 0.90 |

4-Ball EP testing, modified Timken testing, corrosion testing, and oxidation testing demonstrate the performance of HV SLC (High Viscosity Synthetic Lubricant Composition). In motor oils, it provides increased anti-wear and anti-friction benefits. HV SLC may be used as a superior quality open gear and wire rope lubricant. It advances the art of these lubricants though use of more friendly, efficient chemistry. HV SLC may also be used as a gear oil enhancer, which provides enhanced viscometric, anti-wear, anti-friction, and lubricant stability (oxidation) benefits. The performance properties are evaluated in the following tests in Tables 42–43.

TABLE 42

4-BALL EP TESTING*

| Lubricant | Weld Load | Load Wear Index |
|---|---|---|
| Commercial Open Gear Lubricant T | 160 kilograms | 42.3 |
| Commercial Open Gear Lubricant T + 1.0% Lead Naphthenate and 0.5% Chlorinated Paraffin | 200 kilograms | 52.5 |
| HV SLC | 500 kilograms | 72.5 |

TABLE 43

MODIFIED TIMKEN TESTING

| Lubricant | Wear Scar | Seizure Load |
|---|---|---|
| Commercial Open Gear Lubricant T | 60 mm | 8 lbs. |
| Commercial Open Gear Lubricant T + 1.0% Lead Naphthenate and 0.5% Chlorinated Paraffin | 55 mm | 12 lbs. |
| HV SLC | 40 mm | 31 lbs. |

The formulas disclosed in Tables 44, 45, and 46 disclose representative fuel additive versions of the invention. The fuel additive formulas provide added lubricity and dispersancy to fuel (gasoline or diesel). Testing with bench and 2-Cycle Engine tests demonstrate the ability of the invention to improve fuel performance.

TABLE 44

| Ingredients Formula P | % Volume |
|---|---|
| Ketjenlube 1300 | 40.0 |
| Vistone A-30 or Vistone A-10 | 45.0 |
| Fullerene Concentrate | 10.0 |
| Bismuth Naphthenate | 5.0 |

TABLE 45

| Ingredients Formula Q | % Volume |
|---|---|
| Ketjenlube 1300 or Ketjenlube 2300 | 45.0 |
| Vistone A-30 or Vistone A-10 | 45.0 |
| Fullerene Concentrate | 10.0 |

TABLE 46

| Ingredients Formula R | % Volume |
|---|---|
| Ketjenlube 1300 or Ketjenlube 2300 | 40.0 |
| Vistone A-30 or Vistone A-10 | 45.0 |
| Fullerene Concentrate | 10.0 |
| Molyvan 822 | 5.0 |

4-Ball tests were run on samples of diesel fuel and the mixtures noted in Tables 44, 45 and 46. The results of these tests note improved anti-wear and extreme pressure performance from the invention. The Commercial Lubricity Additive is a widely used diesel fuel lubricity aid. The 4-Ball tests note improved lubricity with this additive. 4-Ball tests also disclose the well-documented loss of lubricity from low sulfur diesel fuel (fuel 89 is "high sulfur" and fuel 97 is a "low sulfur" fuel) in Table 46.

TABLE 47

4-BALL EP TESTING

| Sample | Wear Scar @ 40 kilograms, 1 minute run @ 1760 rpm |
|---|---|
| Diesel Fuel #2 Reference (Commercial Fuel) 89 | 1.35 mm |
| Diesel Fuel #2 Reference (commercial Fuel) 97 | 1.65 mm |
| Diesel Fuel #2 89 + 0.02% Commercial Lubricity Additive | 1.25 mm |
| Diesel Fuel #2 89 Detergent Additive | 1.30 mm |
| Diesel Fuel 97 + 0.02% P | 1.50 mm |
| Diesel Fuel 97 + 0.02% Commercial Lubricity Additive | 1.58 mm |
| Diesel Fuel + 0.02% Q | 1.50 mm |
| Diesel Fuel + 0.02% R | 1.59 mm |

A series of "Lubricity or Torque" tests were run with several of the fuel additives. These tests are used as part of the JASO (Japanese Automobile Standards Organization) tests for 2-Cycle Oils.

The tests demonstrate the ability of the invention to reduce friction on piston skirts and cylinder walls in a gasoline engine. The tests use a Honda Super DIO SK50M engine and a fuel oil ratio of 50:1. Lubricity and Initial Torque values are evaluated for 2-Cycle lubricants. The higher the lubricity and initial torque value the better the lubricant. The following Table 48 notes the performance of Formulas P, Q and R in a reference lubricant.

TABLE 48

2-CYCLE TORQUE AND LUBRICITY TESTING

| Lubricant | Lubricity | Initial Torque |
|---|---|---|
| JASO Limits | ≧95 (FC and FB) | ≧98 (FC and FB) |
| Reference Oil | 97 | 100 |
| Reference Oil + 5% P | 112 | 102 |
| Reference Oil + 5% Q | 114 | 103 |
| Reference Oil + 5% R | 102 | 99 |

While the invention has been described in terms of specific embodiments, it is evident in view of the foregoing description that numerous alternatives, modifications and variations will be apparent to those skilled in the art. Thus, the invention is intended to encompass all such alternatives, modifications and variations which fall within the scope and spirit of the invention and the appended claims.

We claim:

1. A lubricating composition for a two-cycle internal combustion engine, comprising an ester copolymer and a diester, wherein the ester copolymer has a viscosity of about 100–700 $mm^2/s$ at 100° C. and is a copolymer of an alpha olefin and a diester selected from a dialkyl fumarate and a dialkyl maleate.

2. The composition of claim 1 wherein the alpha olefin has 6–18 carbon atoms.

3. The composition of claim 1 wherein the alkyl group of the dialkyl fumarate or dialkyl maleate has 1–10 carbon atoms.

4. The composition of claim 1 wherein the copolymer is prepared from a dialkyl fumarate.

5. The composition of claim 1 wherein the alpha olefin comprises $C_{12}$ alpha olefin, the $C_{12}$ alpha olefin is the predominate or exclusive alpha olefin, and the dialkyl fumarate comprises dialkyl fumarate with a $C_4$ alkyl group.

6. The composition of claim 1 further comprising one or more additives selected from methylcyclopentadienyl magnesium tricarbonyl, organo-molybdenum compound, organo-bismuth compound, and dimercapto diazole.

7. The composition of claim 1 further comprising liquid hydrocarbon.

8. The composition of claim 1 further comprising mineral oil.

9. The composition of claim further comprising methylcyclopentadienyl manganese tricarbonyl.

10. A synthetic lubricating composition (SLC), comprising an ester copolymer of an alpha olefin and a diester selected from a dialkyl fumarate and a dialkyl maleate, and a diester having two ester groups, wherein the ester copolymer has a viscosity of about 100–700 $mm^2/s$ at 100° C., and wherein the ester copolymer and/or the diester having two ester groups is/are in a total concentration of 2–10 volume percent based on the volume of synthetic lubricant composition.

* * * * *